US006144395A

United States Patent [19]

Sawano

[11] Patent Number: 6,144,395

[45] Date of Patent: Nov. 7, 2000

[54] PRINTER WITH PREHEATING OF SHEET

[75] Inventor: Mitsuru Sawano, Fujinomiya, Japan

[73] Assignee: Fuji Photo Film Co., Ltd., Kanagawa, Japan

[21] Appl. No.: 08/997,533

[22] Filed: Dec. 23, 1997

[30] Foreign Application Priority Data

Dec. 25, 1996 [JP] Japan ..... 8-345807
May 29, 1997 [JP] Japan ..... 9-140178

[51] Int. Cl.[7] ..... B41J 2/38
[52] U.S. Cl. ..... 347/187
[58] Field of Search ..... 347/185, 186, 347/187, 213; 400/120.08

[56] References Cited

U.S. PATENT DOCUMENTS 5,553,951 9/1996 Simpson et al. ..... 347/187

FOREIGN PATENT DOCUMENTS 2-538 1/1990 Japan ..... 347/187
2-88253 3/1990 Japan ..... 347/187
3-126561 5/1991 Japan ..... 347/187
7-290735 11/1995 Japan .
8-025677 1/1996 Japan ..... 347/187

*Primary Examiner*—Huan Tran
*Attorney, Agent, or Firm*—Sughrue, Mion, Zinn, Macpeak & Seas, PLLC

[57] ABSTRACT

A printer with sheet preheating in which toner applied to a toner ribbon is heat-transferred onto a heat adhesive recording sheet, wherein: a heating member heats the recording sheet at a temperature within the range of predetermined temperatures before the heat transfer is provided. Accordingly, the heat adhesiveness of the recording sheet can be substantially constant regardless of the environment of circumferential temperature, and the variation in sensitivities due to the difference in environment to be used and the difference in the order of transfer can be reduced.

18 Claims, 10 Drawing Sheets

PRINTER WITH PREHEATING OF SHEET

BACKGROUND OF THE INVENTION

1 Field of the Invention

The present invention relates to a printer with sheet preheating in which a thin film heat transfer toner ribbon material is heat-transferred onto a recording sheet by a thermal head or a laser.

2 Description of the Related Art

Conventionally, for example, as shown in FIG. 8, a printer 1 using a line thermal head includes as main structural members: a thermal head 3; a platen roller 5 which opposes a resistance heat generating body 3*a* of the thermal head 3; a toner ribbon 7 which is disposed between the thermal head 3 and the platen roller 5 and which is supplied from a conveying side 7*a* and is taken up onto a winding side 7*b*; a guide roller 9 which guides the toner ribbon 7; a pinch roller 11 and a capstan roller 13 which are provided at the downstream side of the thermal head 3 in the feeding direction of a recording sheet; and a back-up roller 15 which abuts the pinch roller 11.

As shown in FIGS. 9A through 9C, in order to effect heat recording onto a recording sheet in the printer 1 structured as described above, firstly, a heat adhesive recording sheet (a recording sheet) 17 which has a heat adhesive layer 17*a* on the surface is fed (see FIG. 9A). The toner ribbon 7 is superposed on the recording sheet 17, and the toner ribbon 7 and the recording sheet 17 are inserted between the thermal head 3 and the platen roller 5. Next, when a portion of the resistance heat generating body dots corresponding to an image to be printed is selectively heated, adhesive strength of the surface of the recording sheet is increased and toner adheres onto the recording sheet 17 from the toner ribbon 7 (see FIG. 9B). Subsequently, when the toner ribbon 7 separates from the recording sheet 17 while the recording sheet 17 is conveyed, only the toner portion t adhered to the surface of the recording sheet is remained and fixed onto the recording sheet 17 (see FIG. 9C). In this way, the image information is recorded onto an image receiving surface of the recording sheet 17.

However, in the aforementioned conventional heat transfer type printer 1, a predetermined amount of thermal energy is supplied to the toner ribbon 7 from the thermal head or laser, and the toner and the surface of the recording sheet are heated for transfer. Accordingly, the heat adhesiveness of the surface of the recording sheet is changed by environment to be used (in particular, temperature) and sensitivity (the degree of amount of transfer relative to the amount of heat to be supplied) varies. Thus, there is a drawback in that recording densities become different.

Namely, in the recording sheet 17 shown in FIG. 10A, a surface polymer which forms the heat adhesive layer 17*a* tends to harden at low temperature. As a result, the adhesive strength of the recording sheet 17 lowers in low-temperature environment. On the other hand, if the heat adhesive layer 17*a* is heated in advance, the adhesive strength of the recording sheet remains high even if the recording takes place several hours later.

Therefore, as shown in FIG. 10B, when a plurality of colors are superposed and recorded onto the recording sheet 17, a first color 19*a* is directly recorded onto the surface of the recording sheet 17 and a second color 19*b* is superposed and recorded onto the toner of a first color 19 which has been recorded onto the recording sheet 17. In this case, the head adhesive strength of the second color 19*b*, which is heated again, is higher than that of the first color 19*a*. As a result, the sensitivities become different and a drawback arises in that the recording densities become different.

SUMMARY OF THE INVENTION

The present invention was developed in light of the above circumstances, and the object thereof is to provide a printer with sheet preheating in which sensitivity does not vary due to the difference in environment and difference in the order of transfer.

In order to achieve the above-described object, a first aspect of the present invention is a printer with sheet preheating in which toner applied to a toner ribbon is heat-transferred onto a heat adhesive recording sheet, wherein: heating means which heats the recording sheet at a temperature within a range of predetermined temperatures before the heat transfer is provided.

It is preferable that said heating means is a pinch roller in which a heater is built.

Further, said heating means may be a heat roller provided at the upstream side of said heat transfer means in the feeding direction of the recording sheet.

Moreover, said heating means can be a radiation heater provided at the upstream side of said heat transfer means in the feeding direction of the recording sheet.

Furthermore, it is preferable that the range of predetermined temperatures is from 70° C. to 120° C.

Because the above-structured printer includes the heating means which heats the recording sheet at a temperature before the heat transfer, the adhesiveness of the heat adhesive recording sheet can be substantially constant regardless of the environment of circumferential temperature and the like.

In the printer with sheet preheating in which the pinch roller serves as heating means, it is not necessary to provide a new member independently, such that the number of parts of the device does not increase.

Further, in the printer with sheet preheating in which the heat roller provided at the upstream side of the heat transfer means in the feeding direction of the recording sheet serves as heating means, there is no need to convey the recording sheet reciprocally for heating.

Moreover, in the printer with sheet preheating in which the radiation heater provided at the upstream side of the heat transfer means at the feeding direction of the recording sheet serves as heating means, because the recording sheet is heated by radiation, the contact between the heating means and the recording sheet is prevented.

Furthermore, in the printer with sheet preheating which uses the heating means for heating the surface of the recording sheet at the side opposite the transferred surface thereof, the adhesion of toner to the heating means, which occurs in a case in which the heating means contacts and heats the transferred surface of the recording sheet, is prevented.

Still further, in the printer with sheet preheating in which the heat source and the heat roller for transferring the toner on the recording sheet to the main paper are used as heating means, there is no need to provide separate heating means.

DESCRIPTION OF THE PREFERRED EMBODIMENTS

A printer with sheet preheating relating to the preferred embodiments of the present invention will be explained in detail hereinafter with reference to the drawings.

Figure 1:
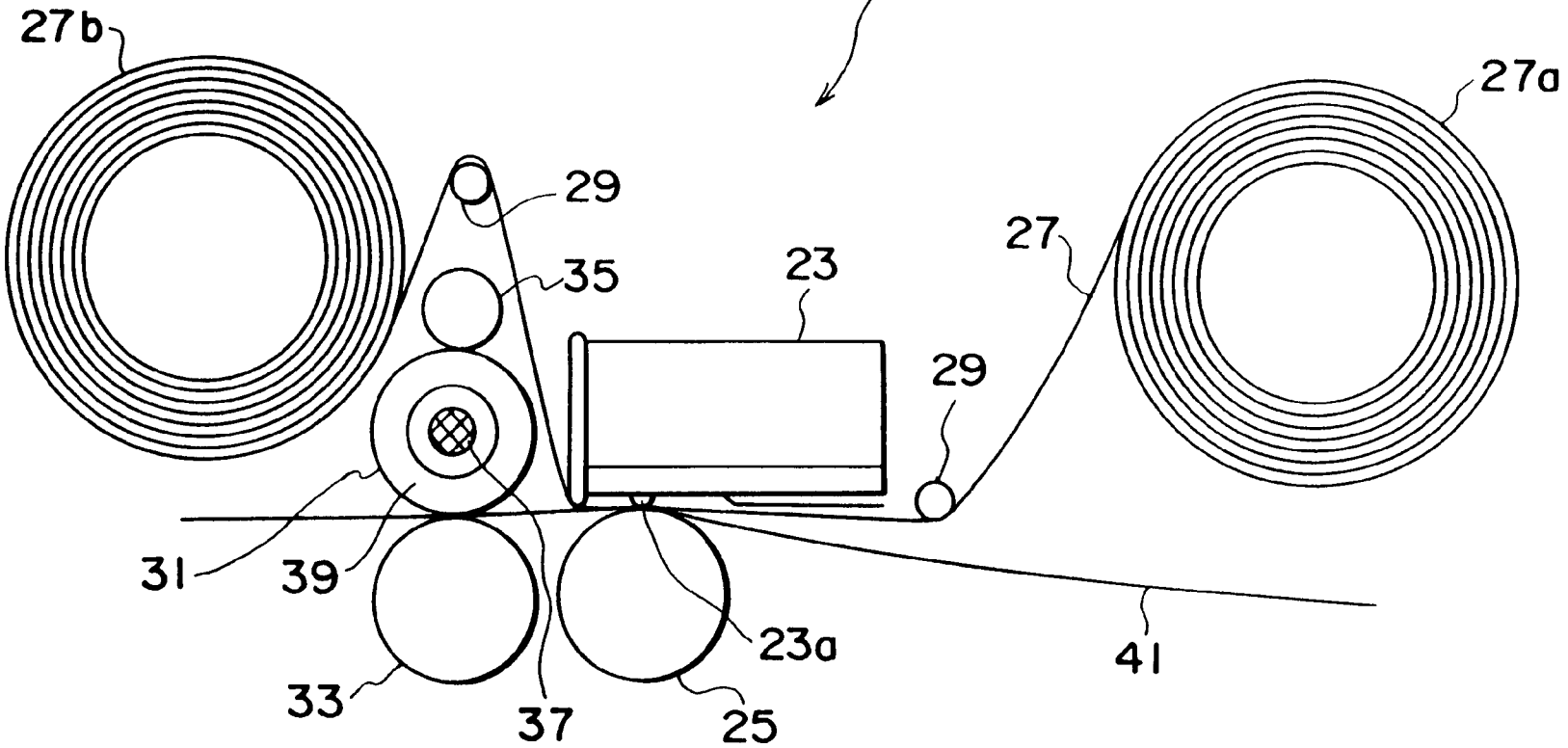
FIG. 1 is a schematic structural view of a printer with sheet preheating relating to a first embodiment of the present invention.

FIG. 1 is a schematic structural view of a printer with sheet preheating relating to a first embodiment of the present invention.

A heat transfer color printer (e.g., a line thermal printer) 21 serving as a printer with sheet preheating includes as main structural members: a thermal head 23 serving as heat transfer means; a platen roller 25 which opposes a resistance heat generating body 23*a* of the thermal head 23; a toner ribbon 27 which is disposed between the thermal head 23 and the platen roller 25 and which is supplied from a conveying side 27*a* and is taken up onto a winding side 27*b*; a guide roller 29 which guides the toner ribbon 27; a pinch roller 31 and a capstan roller 33 which are provided at the downstream side of the thermal head 23 in the feeding direction of a recording sheet; and a back-up roller 35 which abuts the pinch roller 31.

For example, a halogen heater 37, which is elongated in the axial direction of the pinch roller 31, is built in the center of the pinch roller 31. The halogen heater 37 is connected to an unillustrated power supply line and generates heat at predetermined temperature. A silicon rubber 39 is formed in the cylindrical shape at the outer circumference of the halogen heater 37, and the outer circumference of the silicon rubber 39 closely contacts the capstan roller 33. Namely, the pinch roller 31 forms heating means in which the halogen heater 37 serves as a heat source, and a predetermined amount of heat can be supplied to a recording sheet 41 which is inserted between the pinch roller 31 and the capstan roller 33.

The operation of the heat transfer color printer 21 structured as described above will be explained.

In advance of the heat recording by the thermal head 23, firstly, the recording sheet 41 is fed from the right-hand side in FIG. 1 and is conveyed in the left direction in FIG. 1 until the proximal end of the recording sheet 41 reaches the pinch roller 31. In this way, the recording sheet 41 is heated by the high-temperature pinch roller 31 which has been heated by the halogen heater 37 serving as a heat source.

Next, when the proximal end of the recording sheet 41 reaches the pinch roller 31, the capstan roller 33 is reversely rotated and the recording sheet 41 is rewound in the right direction in FIG. 1. In this way, the recording sheet 41 is heated again by the pinch roller 31 and is raised to predetermined temperature.

When the distal end of the recording sheet 41 returns to the position of the capstan roller 33, the capstan roller 33 is switched to the normal rotation and printing is started by the thermal head 23.

The printing by the thermal head 23 is effected in the same manner as the conventional printing. The toner ribbon 27 is superposed on the recording sheet 41 and the toner ribbon 27 and the recording sheet 41 are inserted between the thermal head 23 and the platen roller 25. A portion of the resistance heat generating body dots corresponding to an image to be printed is selectively heated. In this way, the toner applied to the toner ribbon 27 and the recording sheet 41 are heated for transfer.

At this time, the recording sheet 41 reaches predetermined temperature by the pinch roller 31 serving as heating means and the heat adhesiveness of the surface of the recording sheet is stabilized.

Further, in a case in which a plurality of colors is superposed and recorded onto the recording sheet 41, since the recording sheet 41 is heated at predetermined temperature, the heat adhesiveness of the surface of the recording sheet becomes high. In this way, the heat adhesiveness of a first color which is directly recorded onto the surface of the recording sheet 41 and that of a second color which is superposed and recorded onto the toner of a first color, which has already been recorded onto the recording sheet 41, are the same. Thus, the recording can be carried out at the same sensitivity.

In this way, in accordance with the aforementioned heat transfer color printer 21, the pinch roller 31 serves as heating means, the recording sheet 41 is heated before the heat recording by the thermal head 23, and heat recording is effected on the recording sheet 41 which has been heated at predetermined temperature. Therefore, the variation in sensitivities due to the difference in environment to be used and difference in the order of transfer can be reduced, and the difference in recording densities can be minimized.

Further, in accordance with the heat transfer color printer 21, because the halogen heater 37 is built in the pinch roller 31, the recording sheet 41 can be heated without increasing the number of parts of the device.

Moreover, in this embodiment, since the heating can take place twice as the recording sheet 41 moves reciprocally, the temperature of the halogen heater 37 can be set low.

In addition to the aforementioned procedure of heating the recording sheet 41 in the heat transfer color printer 21, it is possible that the recording sheet 41 is fed, for example, from the left-hand side in FIG. 1 and is conveyed in the right direction in FIG. 1. When the left end of the recording sheet 41 reaches the position of the capstan roller 33, the capstan roller 33 is stopped, and thereafter, the feeding direction of the recording sheet 41 is changed to the left in FIG. 1 and printing is started. In this procedure, the number of conveyances can be reduced at the time of heating of the recording sheet 41.

Figure 2:
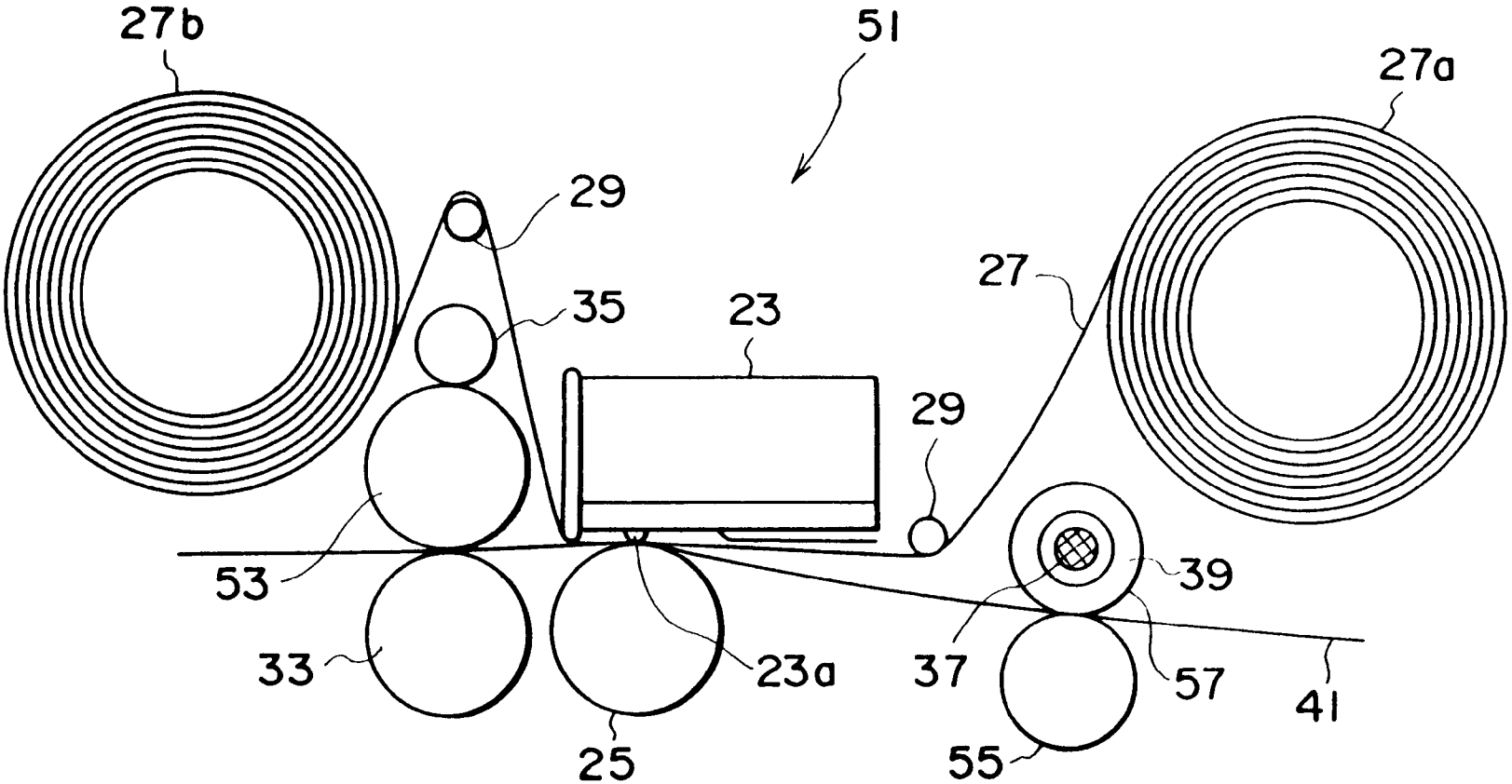
FIG. 2 is a schematic structural view of a printer with sheet preheating relating to a second embodiment of the present invention.

Next, a heat transfer color printer with sheet preheating in relating to a second embodiment of the present invention will be explained. FIG. 2 is a schematic structural view of a printer with sheet preheating relating to the second embodiment of the present invention. Members which are the same as those shown in FIG. 1 are denoted by the same reference numerals, and repetitive descriptions thereof are omitted.

A heat transfer color printer 51 uses an ordinary pinch roller 53 in which the aforementioned halogen heater 37 is not built.

A roller 55, which rotates around a rotational shaft in a direction which is the same as that of the pinch roller 53, and a heat roller 57, which rotates around a rotational shaft parallel to that of the roller 55, are provided at the upstream side of the thermal head 23 in the feeding direction of a recording sheet. As the rotational shaft of the heat roller 57 is moved in parallel by an unillustrated raising and lowering mechanism, the heat roller 57 is movable from the upper side in FIG. 2 in the directions of moving close to and away from the roller 55. For example, a halogen heater 37, which is elongated in the axial direction of the heat roller 57, is provided at the center of the heat roller 57. The halogen heater 37 is connected to an unillustrated power supply line and generates heat at predetermined temperature. For example, a silicon rubber 39 is formed in the cylindrical shape at the outer circumference of the halogen heater 37. Namely, the heat roller 57 forms heating means in which the halogen heater 37 serves as a heat source, and a predetermined amount of heat can be supplied to a recording sheet 41 which is inserted between the roller 55 and the heat roller 57. The other structures are the same as those in the aforementioned heat transfer color printer 21.

In the heat transfer color printer 51 structured as described above, the recording sheet 41 is fed from the right-hand side in FIG. 2. In advance of the heat recording by the thermal head 23, the recording sheet 41 contacts the high-temperature heat roller 57 which has been heated by the halogen heater 37 serving as a heat source. The recording sheet 41 is thereby heated.

Next, when the distal end of the recording sheet 41 reaches the position of the pinch roller 53, printing is started by the thermal head 23.

When the printing progresses and the proximal end of the recording sheet 41 passes between the heat roller 57 and the roller 55, the heat roller 57 is raised several millimeters (mm) from the roller 55 by the unillustrated raising and lowering mechanism and separated from the roller 55.

In accordance with the heat transfer color printer 51, heat recording can be effected on the recording sheet 41 which has been heated at predetermined temperature in the same way as the aforementioned heat transfer color printer 21. Therefore, the variation in sensitivities due to the difference in environment to be used and the difference in order of transfer can be reduced, and the difference in recording densities can be minimized. Additionally, because the heat roller 57 is provided in the feeding direction upstream side of the recording sheet 41, the recording sheet 41 need not be conveyed reciprocally for heating and the recording sheet 41 can be heated while the ordinary feeding operation is effected. The time required for heating can be reduced compared to the case of the first embodiment.

Figure 3:
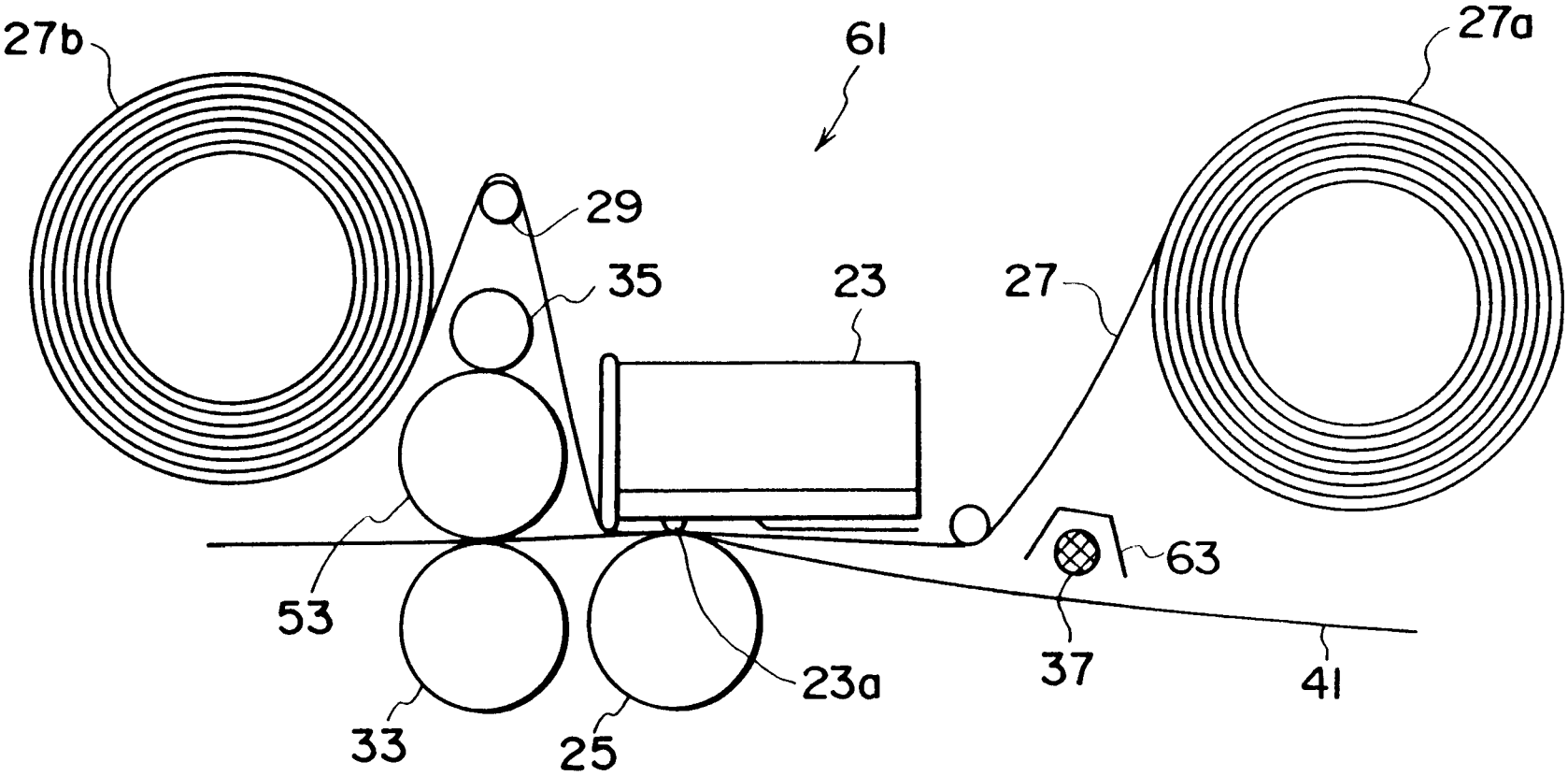
FIG. 3 is a schematic structural view of a printer with sheet preheating relating to a third embodiment of the present invention.

Next, a heat transfer color printer with sheet preheating relating to a third embodiment of the present invention will be explained. FIG. 3 is a schematic structural view of a printer with sheet preheating relating to the third embodiment of the present invention. Members which are the same as those shown in FIG. 1 are denoted by the same reference numerals, and repetitive descriptions thereof are omitted.

A heat transfer color printer 61 uses an ordinary pinch roller 53 in which the aforementioned halogen heater 37 is not built.

A radiation heater (a halogen heater) 37 is provided at the right-hand side of a thermal head 23 in FIG. 3 so as to oppose the recording surface of a recording sheet 41. A heat reflector 63 is provided on the opposite side of the halogen heater 37 with respect to the recording sheet 41. The heat reflector 63 can efficiently supply the heat of the halogen heater 37 to the recording sheet 41 by radiation. The other structures are the same as those of the aforementioned heat transfer color printer 21.

In the heat transfer color printer 61 structured as described above, the recording sheet 41 is fed from the right-hand side in FIG. 3. In advance of the heat recording by the thermal head 23, the recording sheet 41 is heated at predetermined temperature by the radiation from the halogen heater 37.

When the distal end of the recording sheet 41 reaches the position of a capstan roller 53, printing is started by the thermal head 23. When the proximal end of the recording sheet 41 passes the halogen heater 37, the power supply to the halogen heater 37 is stopped.

In accordance with the heat transfer color printer 61, heat recording can be effected on the recording sheet 41 which has been heated at predetermined temperature in the same way as the aforementioned heat transfer color printer 21. Therefore, the variation in sensitivities due to the difference in environment to be used and order of transfer can be reduced, and the difference in recording densities can be minimized. Similarly to the heat transfer color printer 51, the recording sheet 41 can be heated without being conveyed reversely and the time required for heat recording can be reduced. Additionally, since the recording sheet 41 is heated by the radiation from the halogen heater 37, damages, contaminates, and the like to the recording sheet 41 due to the contact with the roller and the like can be prevented.

Figure 4:
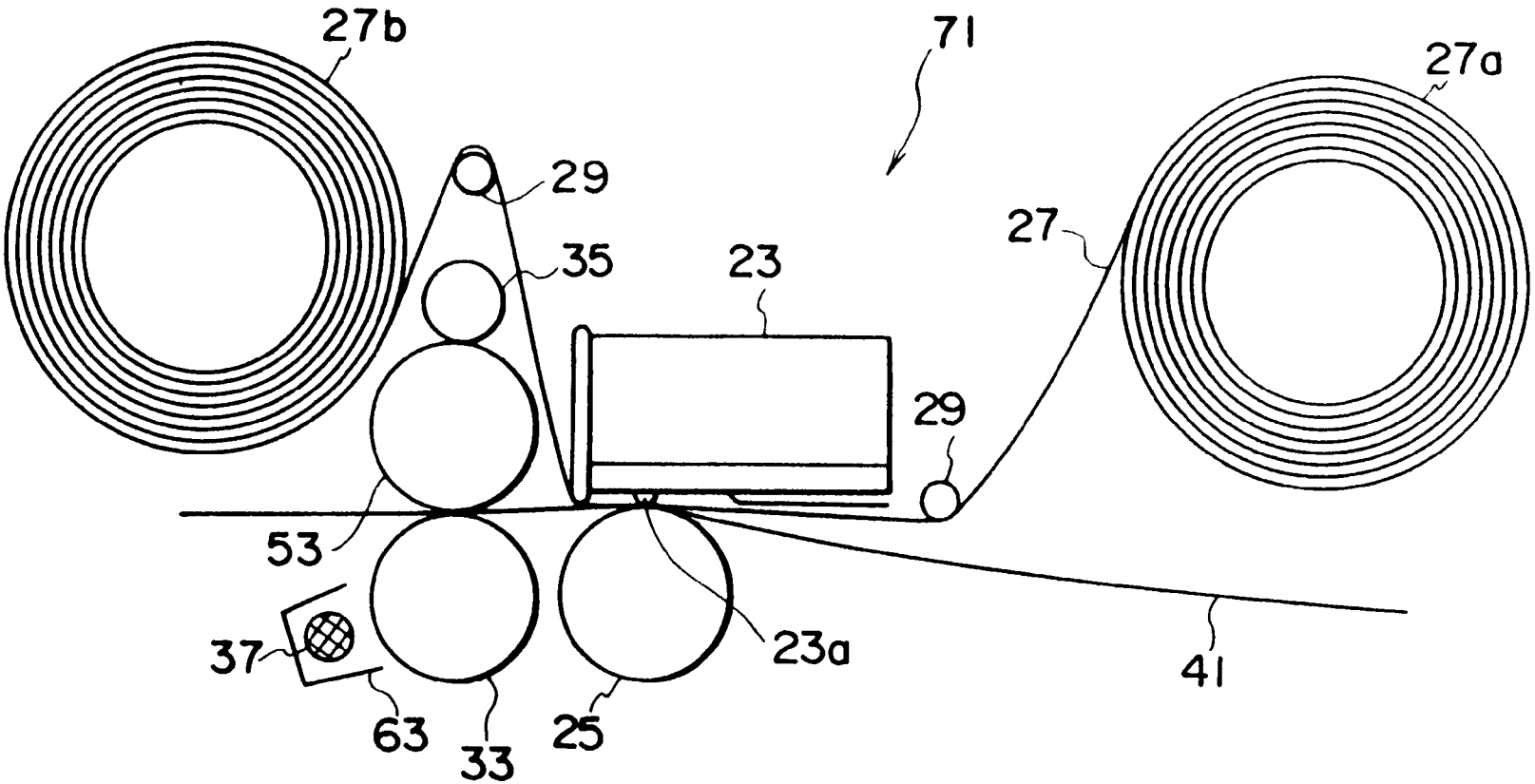
FIG. 4 is a schematic structural view of a printer with sheet preheating relating to a fourth embodiment of the present invention.

Next, a heat transfer color printer with sheet preheating relating to a fourth embodiment of the present invention will be explained. FIG. 4 is a schematic structural view of a printer with sheet preheating relating to the fourth embodiment of the present invention. Members which are the same as those shown in FIG. 1 are denoted by the same reference numerals, and repetitive descriptions thereof are omitted.

A heat transfer color printer 71 uses an ordinary pinch roller 53 in which the aforementioned halogen heater 37 is not built.

A radiation heater (a halogen heater) 37 is provided so as to oppose a capstan roller 33. A heat reflector 63 is provided on the opposite side of the halogen heater 37 with respect to the recording sheet 41. The heat reflector 63 can efficiently supply the heat of the halogen heater 37 to the capstan roller 33 by radiation. The other structures are the same as those of the aforementioned heat transfer color printer 21.

In the heat transfer color printer 71 structured as described above, as in the same manner as the heat transfer color printer 21, the recording sheet 41 is fed from the right-hand side in FIG. 4 in advance of the heat recording by the thermal head 23. The recording sheet 41 is conveyed in the left direction in FIG. 4 until the proximal end of the recording sheet 41 reaches the pinch roller 53. In this way, the surface (reverse surface) of the recording sheet 41 at the side opposite the heat-transferred surface thereof is heated by the high-temperature capstan roller 33 which has been heated by the halogen heater 37 serving as a heat source. Thereafter, in the same manner as the heat transfer color printer 21, the capstan roller 33 is reversely rotated and the recording sheet 41 is rewound in the right direction in FIG. 4. Then, the capstan roller 33 is again switched to the normal rotation and printing is started by the thermal head 23.

In accordance with the heat transfer color printer 71, heat recording can be effected on the recording sheet 41 which has been heated at predetermined temperature in the same way as the aforementioned heat transfer color printer 21. Therefore, the variation in sensitivities due to the difference in environment to be used and the difference in order of transfer can be reduced, and the difference in recording densities can be minimized. Additionally, because the reverse surface of the recording sheet 41 is heated, the adhesion of image receiving material (toner), which occurs when the heat roller contacts and heats the transferred surface of the recording sheet, to the heat roller can be prevented.

Figure 5:
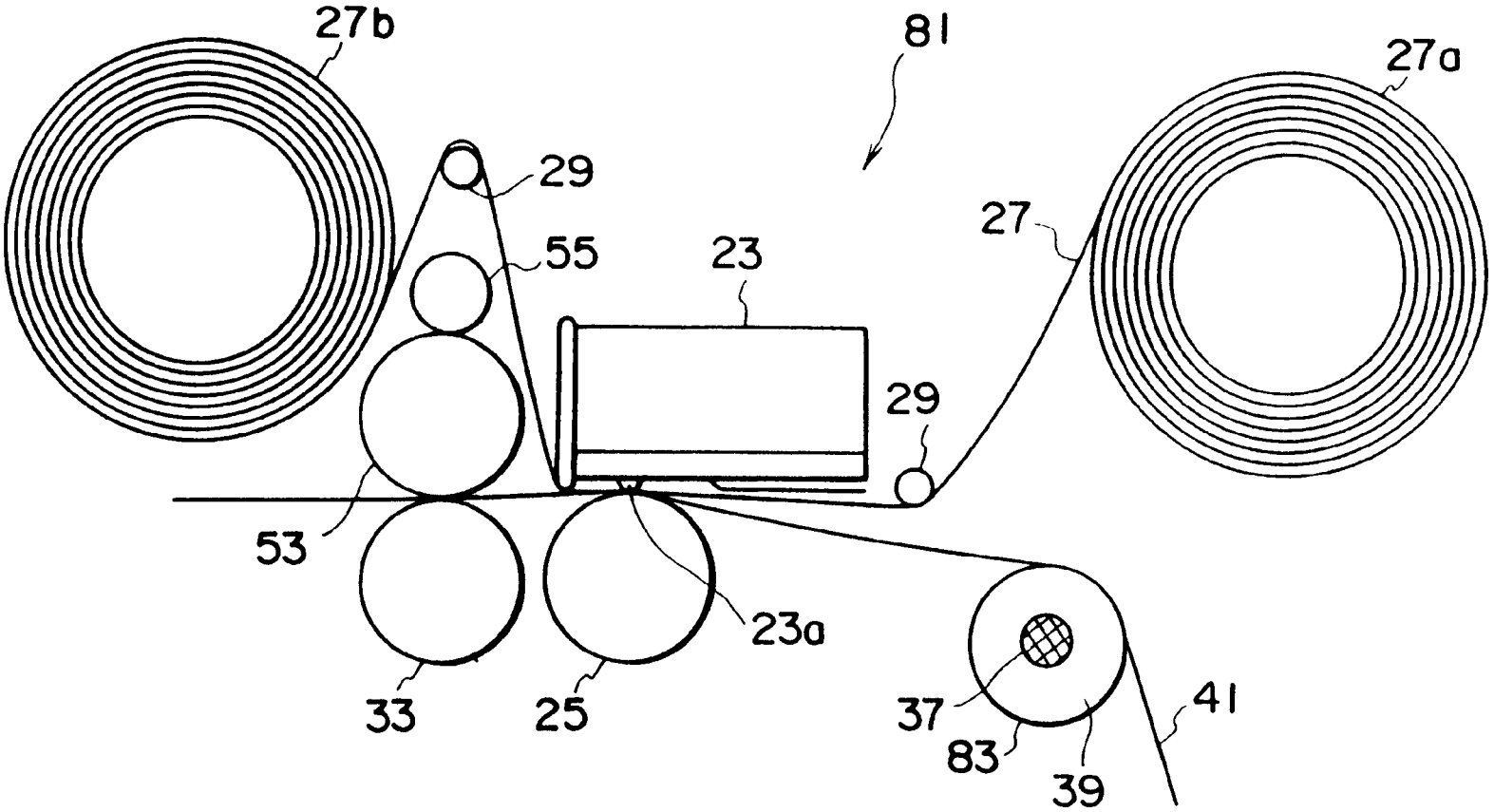
FIG. 5 is a schematic structural view of a printer with sheet preheating relating to a fifth embodiment of the present invention.

Next, a heat transfer color printer with sheet preheating relating to a fifth embodiment of the present invention will be explained. FIG. 5 is a schematic structural view of a printer with sheet preheating relating to the fifth embodiment of the present invention. Members which are the same as those shown in FIG. 1 are denoted by the same reference numerals, and repetitive descriptions thereof are omitted.

A heat transfer color printer 81 uses an ordinary pinch roller 53 in which the aforementioned halogen heater 37 is not built.

A heat roller 83, which rotates around a rotational shaft in the direction which is the reverse of that of the pinch roller 53, is provided at the upstream side of a thermal head 23 in the feeding direction of a recording sheet. A halogen heater 37, which is elongated in the axial direction of the heat roller 83, is provided at the center of the heat roller 83. The halogen heater 37 is connected to an unillustrated power supply line and generates heat at predetermined temperature. For example, a silicon rubber 39 is formed in the cylindrical shape at the outer circumference of the halogen heater 37. Namely, the heat roller 83 forms heating means in which the halogen heater 37 serves as a heat source and, as the heat roller 83 contacts the reverse surface of a recording sheet 41, a predetermined amount of heat can be supplied to the recording sheet 41. The other structures are the same as those in the aforementioned heat transfer color printer 21.

In the heat transfer color printer 81 structured as described above, the recording sheet 41 is fed from the right-hand side in FIG. 5. In advance of the heat recording by the thermal head 23, the reverse surface of the recording sheet 41 contacts the high-temperature heat roller 83 which has been heated by the halogen heater 37 serving as a heat source. The recording sheet 41 is thereby heated.

Next, when the distal end of the recording sheet 41 reaches the position of the capstan roller 33, printing is started by the thermal head 23.

In accordance with the heat transfer color printer 81, heat recording can be effected on the recording sheet 41 which has been heated at predetermined temperature. Therefore, the variation in sensitivities due to the difference in environment to be used and order of transfer can be reduced, and the difference in recording densities can be minimized. Similarly to the heat transfer color printers 51 and 61, the time required for heat recording can be reduced. Additionally, since the reverse surface of the recording sheet 41 is heated, the adhesion of toner to the heat roller 83 can be prevented. Further, since the heat roller 83 is provided independently, the pinch roller 53 which contacts the surface of the recording sheet 41 is not heated indirectly as in the case of the heat transfer color printer 71. Moreover, because the recording sheet 41 can contact the heat roller 83 at a certain winding angle, the recording sheet 41 can be heated sufficiently even at high conveying speed.

Figure 6:
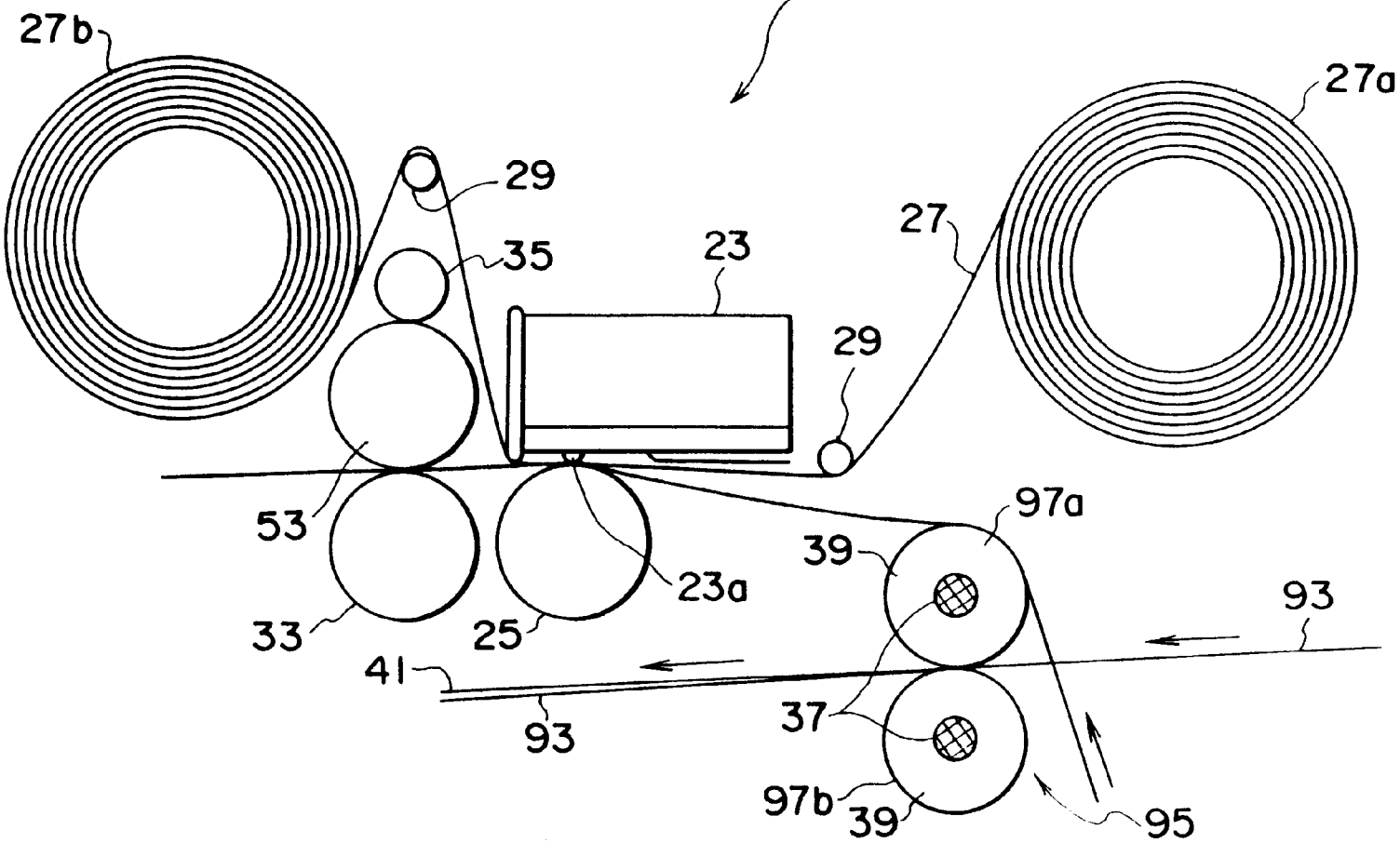
FIG. 6 is a schematic structural view of a printer with sheet preheating relating to a sixth embodiment of the present invention.

Next, a heat transfer color printer with sheet preheating relating to a sixth embodiment of the present invention will be explained. FIG. 6 is a schematic structural view of a printer with sheet preheating relating to the sixth embodiment of the present invention. Members which are the same as those shown in FIG. 1 are denoted by the same reference numerals, and repetitive descriptions thereof are omitted.

A heat transfer color printer 91 uses an ordinary pinch roller 53 in which the aforementioned halogen heater 37 is not built.

A laminater 95, which transfers toner on a recording sheet 41 to a main paper 93, is provided at the upstream side of the thermal head 23 in the feeding direction of the recording sheet. The laminater 95 is formed by a pair of heat rollers 97*a*, 97*b*. The heat rollers 97*a*, 97*b* rotate around a rotational shaft in the direction which is the same as that of the pinch roller 53 and capstan roller 33 while the outer circumferences of the heat rollers 97*a*, 97*b* contact with each other. For example, a halogen heater 37, which is elongated in the axial direction of each of the heat rollers 97*a*, 97*b*, is provided at the center of each of the heat rollers 97*a*, 97*b*. The halogen heater 37 is connected to an unillustrated power supply line and generates heat at predetermined temperature. For example, a silicon rubber 39 is formed in the cylindrical shape at the outer circumference of the halogen heater 37. Namely, the heat rollers 97*a*, 97*b* form heating means in which the halogen heater 37 serves as a heat source, and a predetermined amount of heat can be supplied to the recording sheet 41 and the main paper 93 which are superposed and inserted between the heat rollers 97*a*, 97*b*. Thereby, toner on the recording sheet 41 is transferred to the main paper 93. The other structures are the same as those in the aforementioned heat transfer color printer 21.

In the heat transfer color printer 91 structured as described above, the recording sheet 41 is fed from the right-hand side in FIG. 6. In advance of the heat recording by the thermal head 23, the reverse surface of the recording sheet 41 contacts the high-temperature heat roller 97*a* which has been heated by the halogen heater 37 serving as a heat source. The recording sheet 41 is thereby heated.

Next, when the distal end of the recording sheet 41 reaches the position of the capstan roller 33, printing is started by the thermal head 23.

The distal end of the printed recording sheet 41 is returned to the position at which the heat rollers 97*a*, 97*b* pressing-contact and rotate. The recording sheet 41 and the main paper 93 are superposed and inserted between the heat rollers 97*a*, 97*b* from the distal end sides of the recording sheet 41 and the main paper 93. The toner is thereby transferred on the main paper 93.

In accordance with the heat transfer color printer 91, heat transfer recording can be effected on the recording sheet 41 which has been heated at a predetermined temperature. Therefore, the variation in sensitivities due to the difference in environment to be used and the difference in order of transfer can be reduced, and the difference in recording densities can be minimized. Additionally, because the recording sheet 41 is heated by the heat roller 97*a* of the laminater 95 provided at the feeding direction upstream side of the recording sheet 41, the time required for heat recording can be reduced similarly to the heat transfer color printers 51, 61, 81. Additionally, since the reverse surface of the recording sheet 41 is heated, the adhesion of toner to the heat roller 97*a* can be prevented. Further, since the heat roller 97*a* which does not contact the pinch roller 53 is used, the pinch roller 53 which contacts the surface of the recording sheet 41 is not heated indirectly. Moreover, because the recording sheet 41 can contact the heat roller 97*a* at a certain winding angle, the recording sheet 41 can be heated sufficiently even at high conveying speed. Furthermore, because the heat roller 97*a* of the laminater 95 can be used, the recording sheet 41 can be preheated without providing new heating means in the heat transfer color printer having the laminater 95.

Figure 7:
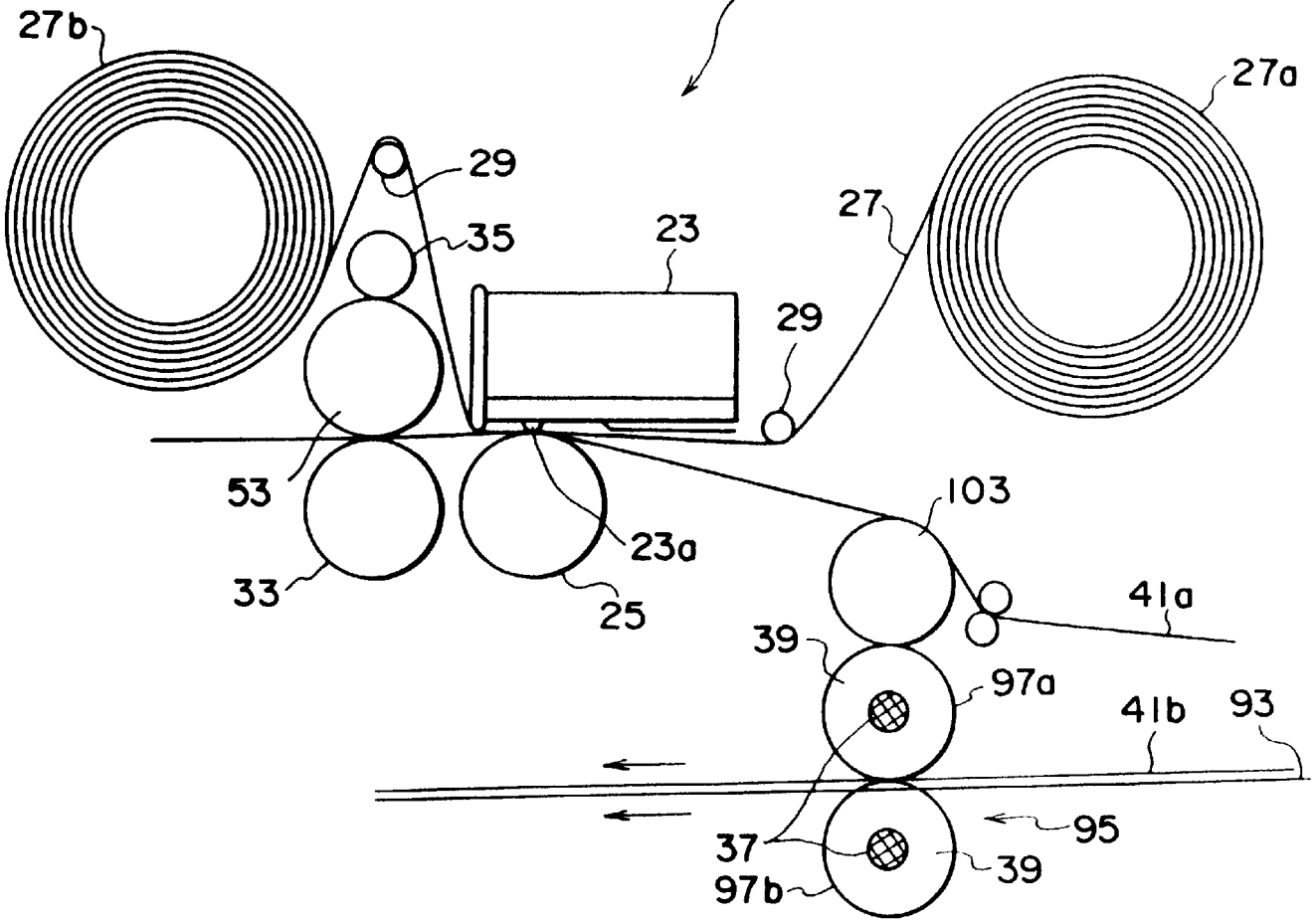
FIG. 7 is a schematic structural view of a printer with sheet preheating relating to a seventh embodiment of the present invention.
Figure 8:
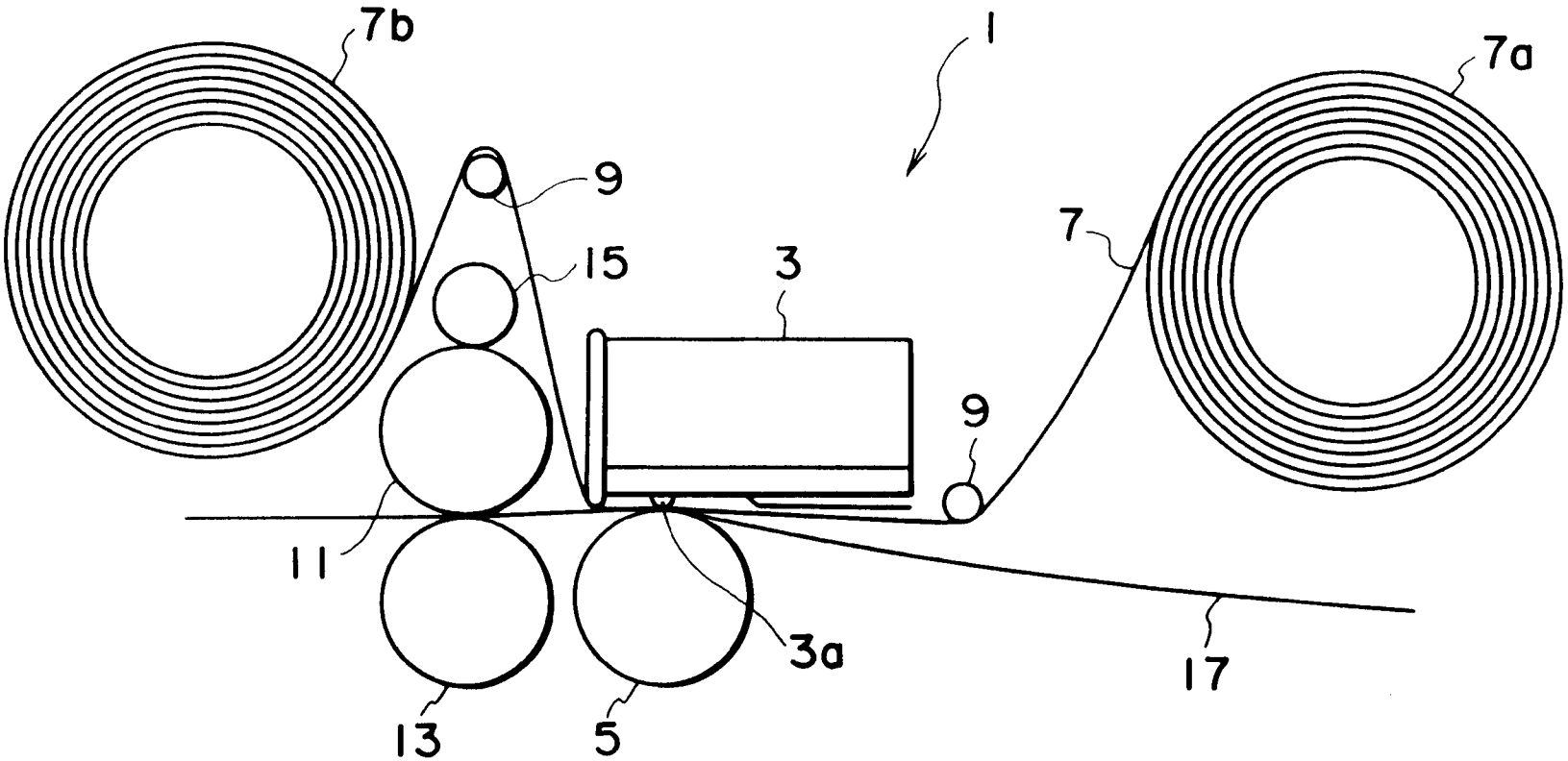
FIG. 8 PRIOR ART
FIG. 8 is a schematic structural view of a conventional printer.
Figure 9A:
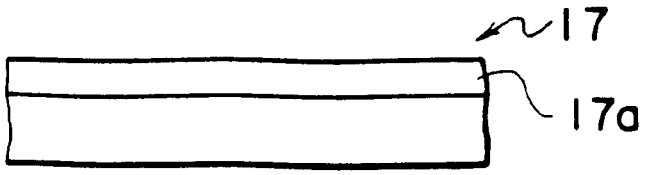
FIG. 9A is an explanatory view which shows a process for heat transfer using a heat transfer toner ribbon.
Figure 9B:
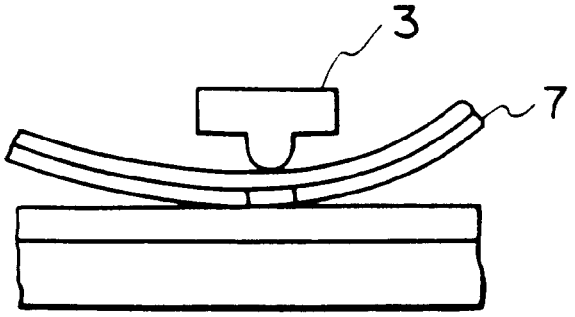
FIG. 9B is an explanatory view which shows a process for heat transfer using a heat transfer toner ribbon.
Figure 9C:
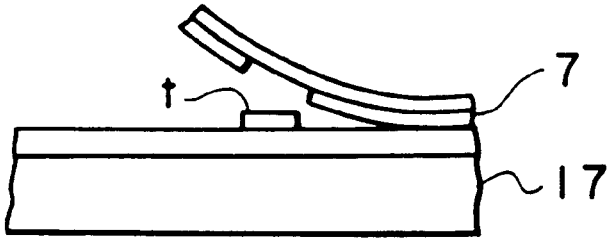
FIG. 9C is an explanatory view which shows a process for heat transfer using a heat transfer toner ribbon.
Figure 10A:
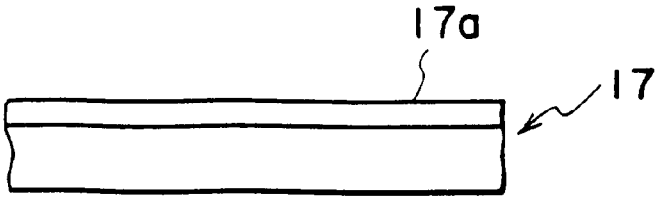
FIG. 10A is an explanatory view of a case in which toners are superposed and recorded onto a recording sheet.
Figure 10B:
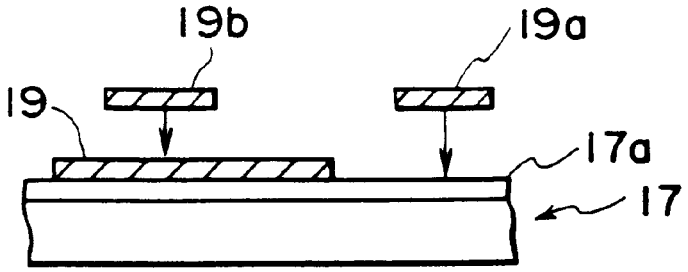
FIG. 10B is an explanatory view of a case in which toners are superposed and recorded onto a recording sheet.

Next, a heat transfer color printer with sheet preheating relating to a seventh embodiment of the present invention will be explained. FIG. 7 is a schematic structural view of a printer with sheet preheating relating to the seventh embodiment of the present invention. Members which are the same as those shown in FIG. 1 are denoted by the same reference numerals, and repetitive descriptions thereof are omitted.

A heat transfer color printer 101 uses an ordinary pinch roller 53 in which the aforementioned halogen heater 37 is not built.

In the same way as the heat transfer color printer 91, a laminater 95, which transfers toner on a recording sheet 41 to a main paper 93, is provided at the upstream side of a thermal head 23 in the feeding direction of the recording sheet. A metal roller 103 for heating (hereinafter, "heating metal roller 103"), which rotates around a rotational shaft in the direction which is the reverse of that of a heat roller 97*a*, contacts the heat roller 97*a* of the laminater 95. The other structures are the same as those in the aforementioned heat transfer color printer 21.

In the heat transfer color printer 101 structured as described above, the recording sheet 41 is fed from the right-hand side in FIG. 7. In advance of the heat recording by the thermal head 23, the reverse surface of the recording sheet 41 contacts the high-temperature heating metal roller 103 which has been heated by contacting the heat roller 97*a*. The recording sheet 41 is thereby heated.

Next, when the distal end of the recording sheet 41 reaches the position of a capstan roller 33, printing is started by the thermal head 23.

Since the heating metal roller 103 is used in the heat transfer color printer 101, the recording sheet 41 conveyed to the thermal head 23 side can be preheated due to the rotation of the laminater 95 at the time in which a main paper 93 and the recording sheet 41 are passed between the laminater 95. Namely, one recording sheet 41*a* can be preheated at the same time that the toner on another recording sheet 41*b* is transferred to the main paper 93.

In accordance with the heat transfer color printer 101, heat transfer recording can be effected on the recording sheet 41 which has been heated at predetermined temperature. Therefore, the variation in sensitivities due to the difference in environment to be used and the difference in order of transfer can be reduced, and the difference in recording densities can be minimized. Additionally, because the recording sheet 41 is heated by the heating metal roller 103 provided at the feeding direction upstream side of the recording sheet 41, the time required for heat recording can be reduced similarly to the heat transfer color printers 51, 61, 81, 91. Additionally, since the reverse surface of the recording sheet 41 is heated, the adhesion of toner to the heating metal roller 103 can be prevented. Further, since the heating metal roller 103 which does not contact the pinch roller 53 is used, the pinch roller 53 which contacts the surface of the recording sheet 41 is not heated indirectly. Moreover, because the recording sheet 41 can contact the heat metal roller 103 at a certain winding angle, the recording sheet 41 can be heated sufficiently even at high conveying speed. Furthermore, because the laminater 95 can be used, the recording sheet 41 is preheated without providing new heating means in the heat transfer color printer having the laminater 95. Still further, since the heating metal roller 103 is provided, the one recording sheet 41*a* can be preheated at the same time that the toner on the other recording sheet 41*b* is transferred to the main paper 93. Thus, the productivity is increased.

EXAMPLES

Heat recording was actually carried out by a heat transfer color printer having a conventional structure (a structure having no heating means) and the aforementioned heat transfer color printers 21, 51, 61, 71, 81, 91, 101 corresponding to structural examples 1, 2, 3, 4, 5, 6, 7. The results of comparison of densities are shown in table 1.

A thermal head 23 having 300 dpi (a heater size main direction 75 m, a heater size sub direction 80 $\mu$m) was used. Under the conditions of electric power of 80 mW, strobing of 3 ms, cycle of 12.6 ms, paper conveying speed of 12.5 mm/s, Color of M (Magenta) of Proof Ribbon J of Digital Color Proofer First Proof manufactured by Fuji Photo Film Co., Ltd. was recorded onto a receiver sheet A3W. A dot percentage recorded in this way was measured by a densitometer X-Rite 938 sold by Nippon Lithograph, Inc.

The measurement was carried out in a case in which the other color is not recorded at all and in a case in which 100% of Color C was printed before the printing of Color M.

TABLE 1

| Measuring object | Temperature Environment | Temperature of heated portion on recording sheet | Dot % (first color) | Dot % (on Color C) |
|---|---|---|---|---|
| Conventional | 23° C. | 25° C. | 40% | 45% |
| structure | 10° C. | 13° C. | 25% | 35% |
| Structural | 23° C. | 95° C. | 45% | 45% |
| Example 1 | 10° C. | 95° C. | 40% | 40% |
| | 23° C. | 60° C. | 42% | 45% |
| | 10° C. | 60° C. | 28% | 36% |
| | 23° C. | 80° C. | 45% | 45% |
| | 10° C. | 80° C. | 40% | 40% |
| Structural | 23° C. | 95° C. | 45% | 45% |
| Example 2 | 10° C. | 95° C. | 40% | 40% |
| | 23° C. | 120° C. | 45% | 45% |
| | 10° C. | 120° C. | 40% | 40% |
| | 23° C. | 140° C. | cannot be conveyed due to adhesion | |
| | 10° C. | 140° C. | | |
| Structural | 23° C. | 95° C. | 45% | 45% |
| Example 3 | 10° C. | 95° C. | 40% | 40% |
| Structural | 23° C. | 95° C. | 45% | 45% |
| Example 4 | 10° C. | 95° C. | 40% | 40% |
| Structural | 23° C. | 95° C. | 45% | 45% |
| Example 5 | 10° C. | 95° C. | 40% | 40% |
| Structural | 23° C. | 95° C. | 45% | 45% |
| Example 6 | 10° C. | 95° C. | 40% | 40% |
| Structural | 23° C. | 95° C. | 45% | 45% |
| Example 7 | 10° C. | 95° C. | 40% | 40% |

As can be seen from Table 1, in Structural Example 1, both the difference in dot % due to the temperature environment and the difference between the case in which Color M is the first color and the case in which Color M is printed on Color C were able to be reduced as compared to the conventional structure by setting the temperature of the heated portion on the recording sheet from 60° C. or more to 140° C. or less. Further, in any of Structural Examples 2, 3, 4, 5, 6, 7, the differences were able to be reduced in common at a substantially intermediate value (95° C.) of the aforementioned temperature range.

Further, in Structural Examples 1, 2, 3, 4, 5, 6, 7, the defects such as a mark with a conveying roller and a mark with a fingerprint copied onto the recording sheet were able to be decreased.

In the aforementioned embodiments, an example is described of a case in which the printer of the present invention was applied to a line thermal printer. However, the printer of the present invention having the same recording material structure can be applied in the same way to a printer in which a serial thermal head undergoes recording and peeling and to a printer in which a heat mode laser undergoes heat recording, pealing, and developing.

As described in detail hereinbefore, in accordance with a printer with sheet preheating relating to the present invention, since the heating means is provided which heats the recording sheet at temperature within predetermined temperatures before the heat transfer, the heat adhesiveness of the recording sheet can be substantially constant regardless of the environment of circumferential temperature, the variation in sensitivities due to the difference in environment to be used and the difference in the order of transfer can be reduced, and the difference in recording densities can be minimized.

In the printer with sheet preheating in which the pinch roller serves as heating means, the recording sheet can be heated without increasing the number of parts of the device.

Further, in the printer with sheet preheating in which the heat roller provided at the upstream side of the heat transfer means in the feeding direction of the recording sheet serves as heating means, the recording sheet need not be conveyed reciprocally for heating, the heating can be effected while the ordinary feeding operation is carried out, and the time required for heat recording can be minimized.

Moreover, in the printer with sheet preheating in which the radiation heater provided at the upstream side of the heat transfer means in the feeding direction of the recording sheet serves as heating means, because the recording sheet is heated by radiation, the damages, contaminates, and the like onto the recording sheet due to the contact with the roller and the like can be prevented.

Furthermore, in the printer with sheet preheating in which uses heating means for heating the surface of the recording sheet at the side opposite the transferred surface thereof, the adhesion of toner to the heating means, which occurs in a case in which the heating means contacts and heats the transferred surface of the recording sheet, can be prevented.

Still further, in the printer with sheet preheating in which the heat source and the heat roller for transferring the toner on the recording sheet to the main paper are used as heating means, the recording sheet can be preheated without providing separate heating means.

What is claimed is:

1. A printer with sheet preheating in which toner applied to a toner ribbon is heat-transferred onto a transfer surface of a heat adhesive recording sheet, comprising:

heat transfer means which heats the toner ribbon and the heat adhesive recording sheet, which are superposed, and which carries out the heat transfer; and heating means which heats the recording sheet at a temperature within a range of predetermined temperatures before said heat transfer means effects the heat transfer of the toner to the transfer surface of the adhesive recording sheet, wherein said heating means is a pinch roller in which a heater is built.

2. A printer with sheet preheating according to claim 1, wherein the range of predetermined temperatures is from 70° C. to 120° C.

3. A printer with sheet preheating according to claim 1, in combination with said toner ribbon.

4. A printer with sheet preheating according to claim 1, wherein the range of predetermined temperatures is from 60° C. to 140° C.

5. A printer with sheet preheating according to claim 4, wherein said pinch roller heats the transfer surface of the recording sheet, the recording sheet being nipped between said pinch roller and a capstan roller.

6. A printer with sheet preheating according to claim 5, wherein silicon rubber is formed in a cylindrical shape at the outer circumference of the heater.

7. A printer with sheet preheating according to claim 4, wherein said heating means is provided at the upstream side of the heat transfer means in the feeding direction of the recording sheet, and said heating means is provided so as to oppose the transfer surface of the recording sheet.

8. A printer with sheet preheating according to claim 1, wherein said pinch roller heats the transfer surface of the recording sheet, the recording sheet being nipped between said pinch roller and a capstan roller.

9. A printer with sheet preheating according to claim 8, wherein said heating means is provided at the upstream side of the heat transfer means in the feeding direction of the recording sheet, and said heating means is provided so as to oppose the transfer surface of the recording sheet.

10. A printer with sheet preheating according to claim 8, wherein silicon rubber is formed in a cylindrical shape at the outer circumference of the heater.

11. A printer with sheet preheating according to claim 1, wherein said heating means is provided at the upstream side of the heat transfer means in the feeding direction of the recording sheet, and said heating means is provided so as to oppose the transfer surface of the recording sheet.

12. A printer with sheet preheating according to claim 11, wherein silicon rubber is formed in a cylindrical shape at the outer circumference of the heater.

13. A printer with sheet preheating in which toner having a first color applied to a toner ribbon is heat-transferred onto a transfer surface of a heat adhesive recording sheet and toner having a second color which is different from the first color applied to the toner ribbon is heat-transferred onto the toner having the first color which has been transferred onto the heat adhesive recording sheet, and a heating means for heating the recording sheet at a temperature within a range of from above 60° C. to below 140° C. before the toner is heat transferred onto the transfer surface of the recording sheet.

14. A printer with sheer preheating according to claim 13, in combination with said toner ribbon.

15. A printer with sheet preheating in which toner having a first color applied to a toner ribbon is heat-transferred onto a transfer surface of a heat adhesive recording sheet and toner having a second color which is different from the first color applied to the toner ribbon is heat-transferred onto the toner having the first color which has been transferred onto the heat adhesive recording sheet, comprising:

heat transfer means which heats the toner ribbon and the heat adhesive recording sheet, which are superposed, and which carries out the heat transfer; and heating means which heats the recording sheet at a temperature within a range of from above 60° C. to below 140° C. before said heat transfer means effects the heat transfer of the toner to the transfer surface of the heat adhesive recording sheet.

16. A printer with sheet preheating according to claim 15, in combination with said toner ribbon.

17. A printer with sheet preheating in which toner having a first color applied to a toner ribbon is heat-transferred onto a transfer surface of a heat adhesive recording sheet and toner having a second color which is different from the first color applied to the toner ribbon is heat-transferred onto the toner having the first color which has been transferred onto the heat adhesive recording sheet, and a heating means for heating the recording sheet at a temperature within a range of from above 70° C. to below 120° C. before the toner is heat transferred onto the transfer surface of the recording sheet.

18. A printer with sheet preheating according to claim 17, in combination with said toner ribbon.

* * * * *